US005214903A

United States Patent [19]

Chen et al.

[11] Patent Number: 5,214,903

[45] Date of Patent: Jun. 1, 1993

[54] METHOD FOR THE PACKING OF DECORATIVE LIGHTING STRINGS AND THE STRUCTURE OF PACKAGE MEANS

[76] Inventors: Sen H. Chen, No. 15, Lane 167, Tung Nan Street; Jeou N. Tseng, No. 52-1, Alley 100, Lane 311, Nan Yea Street; Jeng-Shyong Wu, Fl. 4, No. 5, Hsing Shyue Road, all of Hsin-Chu City, Taiwan

[21] Appl. No.: 712,708

[22] Filed: Jun. 10, 1991

[51] Int. Cl.[5] ..... B65B 35/56; B65B 63/04

[52] U.S. Cl. ..... 53/429; 53/446; 53/473

[58] Field of Search ..... 53/116, 397, 409, 415, 53/429, 474, 580, 594, 446, 473; 206/418, 419, 420, 421

[56] References Cited

U.S. PATENT DOCUMENTS

| | | | |
|---|---|---|---|
| 2,895,210 | 7/1959 | Hubbard | 53/429 |
| 2,984,347 | 5/1961 | Kalinchuk | 206/419 |
| 3,384,227 | 5/1968 | Spatz | 206/420 |
| 3,878,941 | 4/1975 | Kelner | 206/419 |
| 3,931,887 | 1/1976 | Beck | 206/420 X |
| 4,228,896 | 10/1980 | Wu | 206/420 |
| 4,971,200 | 11/1990 | Huang et al. | 206/420 |

FOREIGN PATENT DOCUMENTS

| | | | |
|---|---|---|---|
| 2006304 | 12/1969 | France | 206/419 |

*Primary Examiner*—John Sipos
*Assistant Examiner*—Linda B. Johnson
*Attorney, Agent, or Firm*—Bucknam and Archer

[57] ABSTRACT

A novel method for the packing of decorative lighting strings comprises forming an intermediate section of conductor wire between each pair of adjacent light bulbs into an independent loop and hiding under the unutilized space available behind the light bulbs where stacking rack is optionally provided so that the space originally required to accommodate the conductor wire in the aisle between two parallel rows of string stored can be substantially reduced. The invention relates also to the structure of the package developed based upon said method as well as fastening means for steadily stacking up or extending sidewise of said packages.

11 Claims, 13 Drawing Sheets

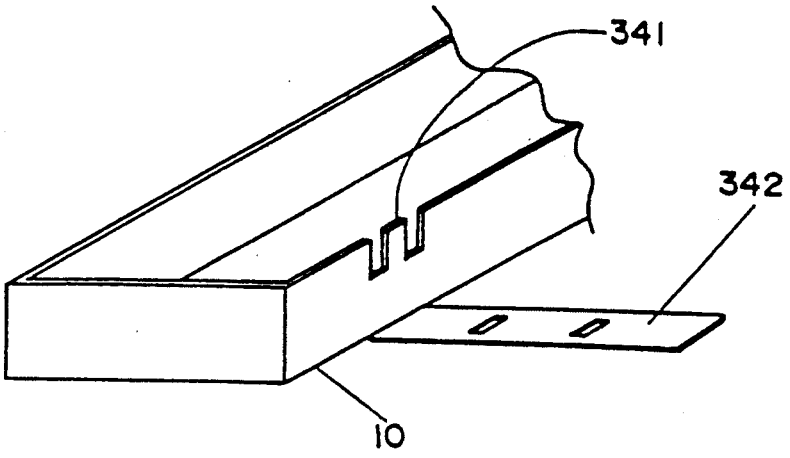
FIG. 8(A)
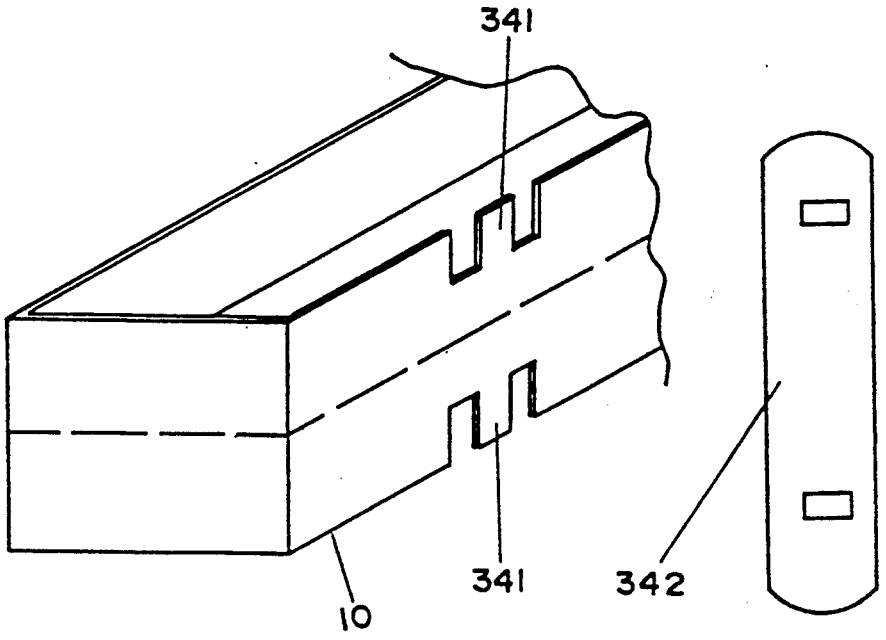
FIG. 8(B)
FIG. 8(C)

METHOD FOR THE PACKING OF DECORATIVE LIGHTING STRINGS AND THE STRUCTURE OF PACKAGE MEANS

The present invention relates to the packing method of decorative lighting strings such as Christmas lighting strings and more particularly to a novel method whereby a significant space saving result is achieved.

Conventional packaging of decorative lighting string is usually effected with a tray of plastic material such as polystyrene and is most commonly in the form of two parallel rows of trench with an aisle there-in-between, the trench with brackets provided for taking individual bulb with socket and the aisle is to accommodate the conductor wires altogether which would seem very crowded and entanglements of wires are often caused.

A generally overlooked and unutilized space does exist in such kind of a package, that is, the space behind the light bulb. Such a space is quite sufficient to hold one third to one half the length of the total conductor wires but this matter has not been considered.

Therefore, the main object of the present invention is to provide a space saving method of packing the light strings by hiding a considerable length of the intermediate conductor wires behind this space.

Another object of the present invention is to provide a space saving package using the above method.

A further object of the present invention is to provide fastening means for steadily stacking up or extending sidewise of the package means during consolidation for storage or shipment.

Other features and objects of the present invention will become apparent by way of the following detailed description in conjunction with the annexed drawings, of which:

Figure 3A:
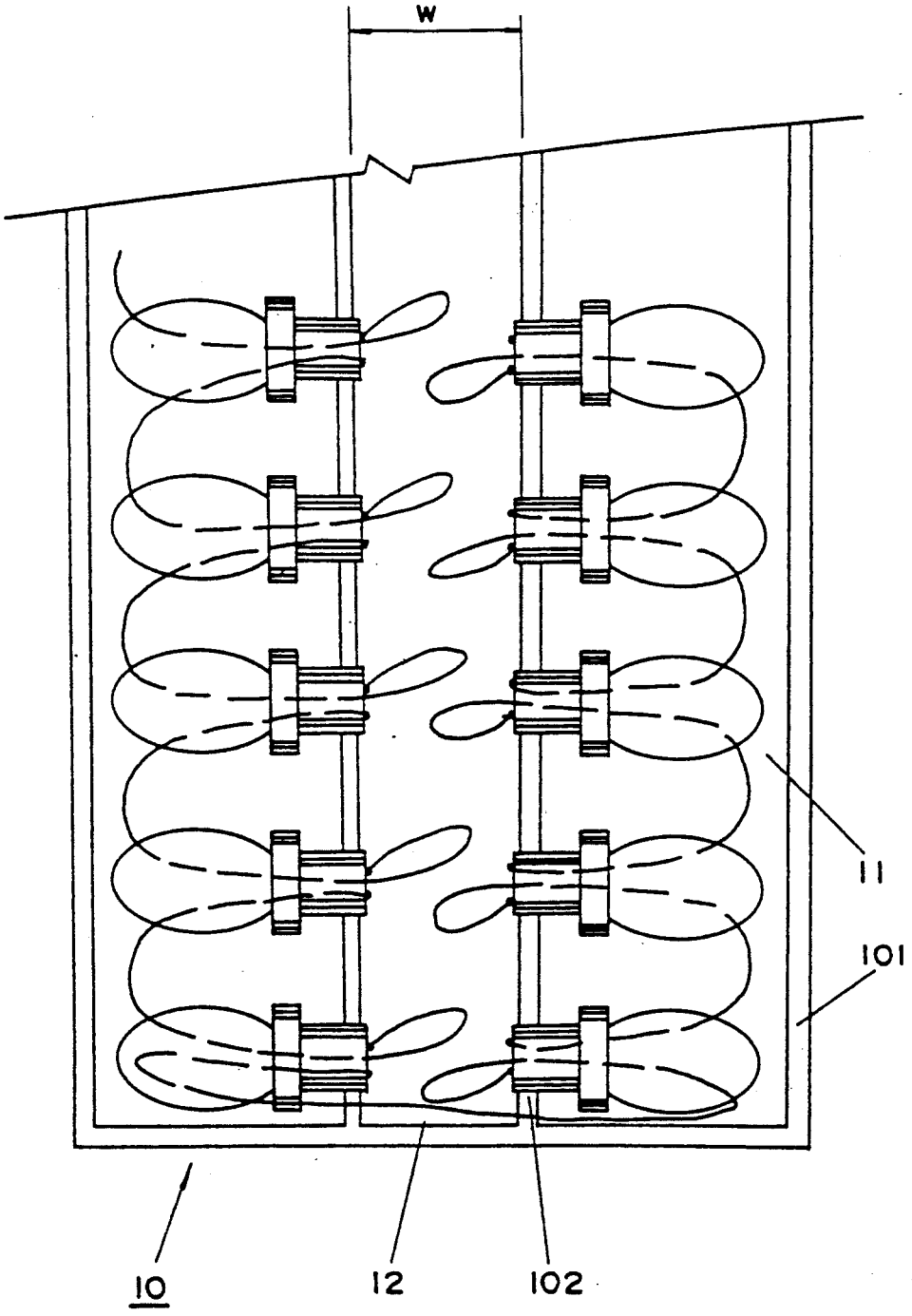

FIGS. 3(A) and (B) illustrate a first embodiment of rectangular tray, showing the ways of hiding the loop of the intermediate length behind the bulbs under one trench or the opposite one; FIGS. 3(C), 3(D), 3(E) and 3(F) show rack means and compartments in the trench. FIG. 3(G) shows particularly where bulbs in different rows are oriented in a same direction.

Figure 4:
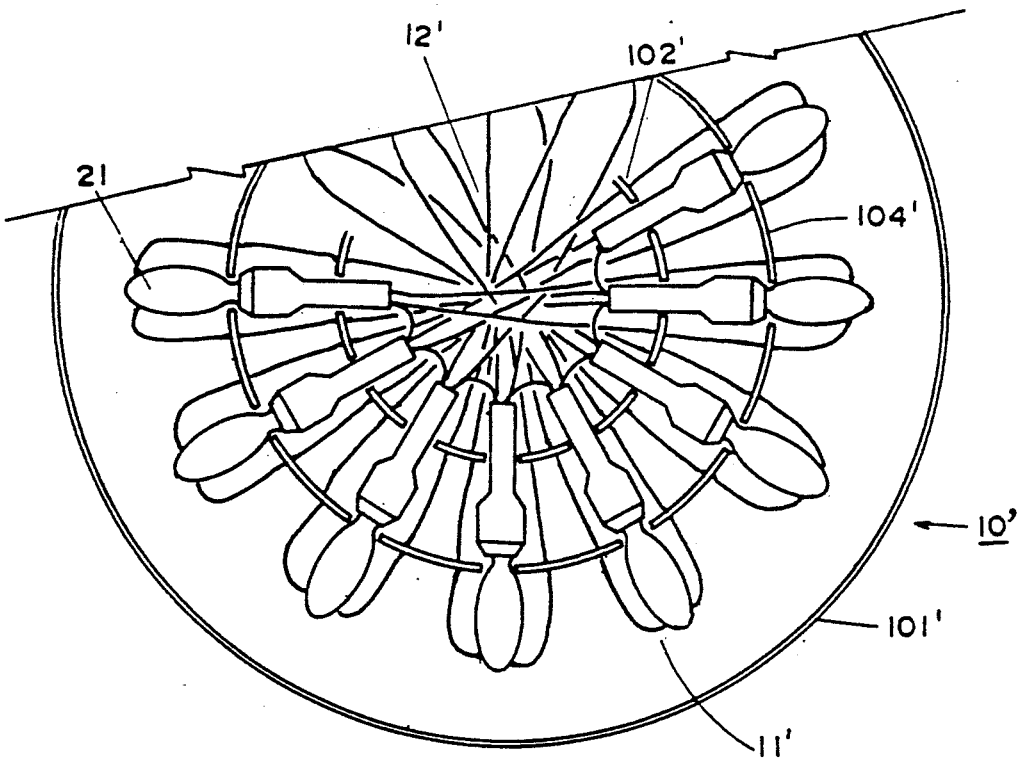

FIGS. 4(A) and (B) depict a second embodiment showing circular package, 4(A) and 4(B) being respectively variations of the direction of bulbs stored.

Figure 5:
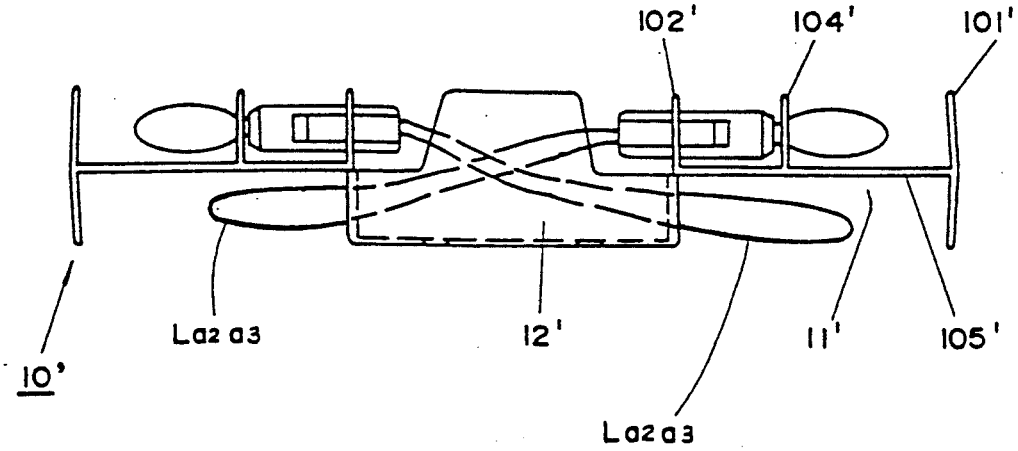

FIGS. 5(A), (B) are sections taken respectively along diametrical line in the FIGS. 4(A) and (B); showing rack means and variations of the hide-away.

Figure 6:
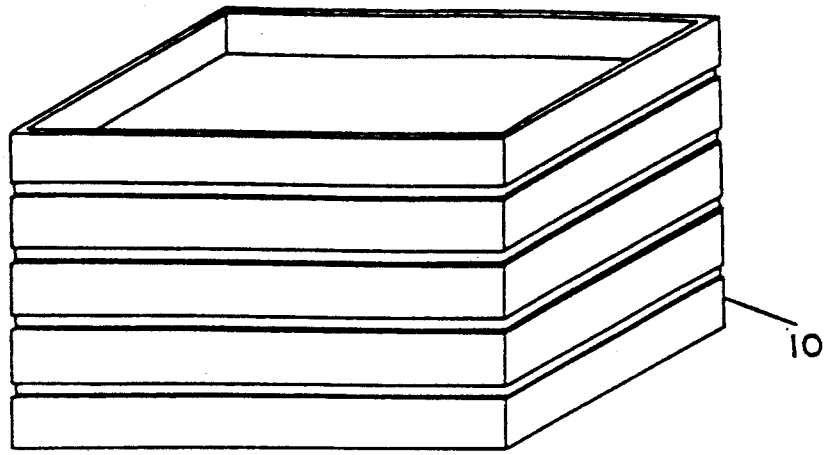
Figure 6B:
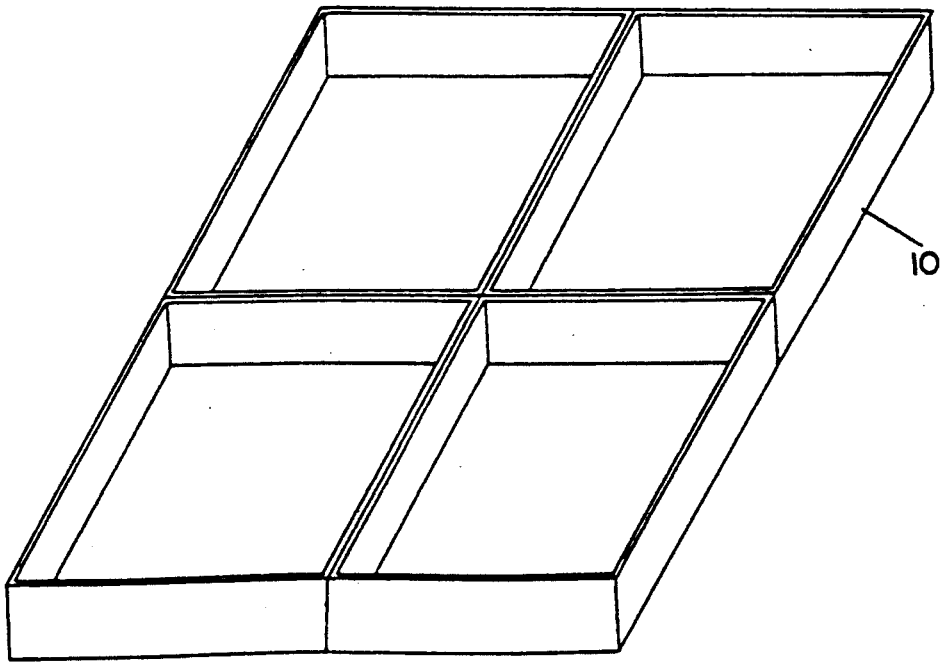

FIG. 6(A) is a perspective view of the stacking up of packages;

FIG. 6(B) is a perspective view of the extension sideways of packages.

FIGS. 7(A) to (K) show examples of fastening means.

FIGS. 8(A), (B) and (C) are further examples of fastening means.

To facilitate reading of the drawings, a list of component is hereunder provided, where equivalent parts are given same numbering:

COMPONENT LIST (Where numbers marked with prime ", ", denoting circular tray)

Figure 1:
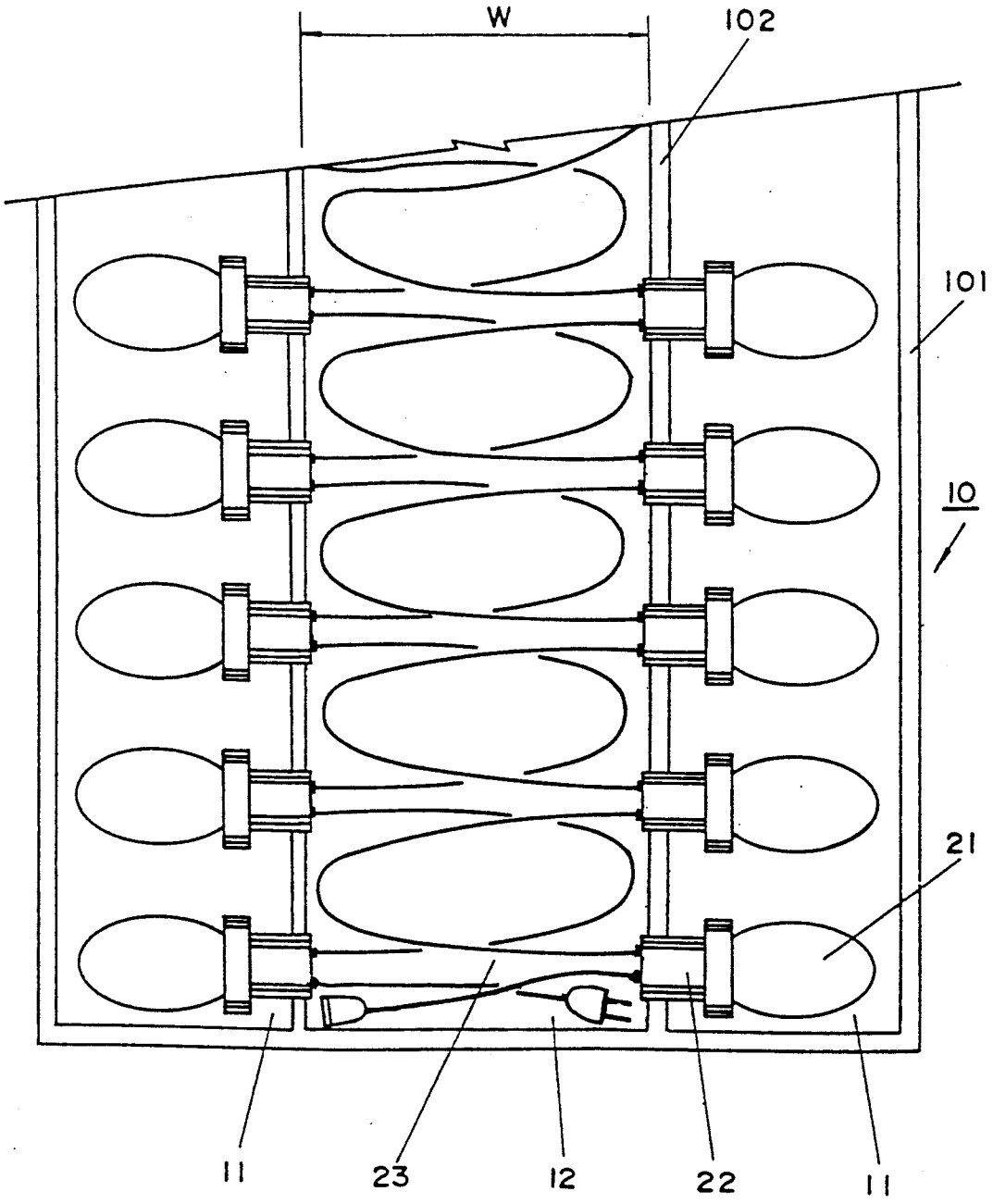
FIG. 1 (PRIOR ART)
FIG. 1 illustrates a top view of a conventional rectangular package of the decorative lighting string.

10 storage tray, rectangular
101 side wall
102 intermediate wall
103 end wall
104 bulb bracket
105 partition floor
11 trench
11U upper compartment
11L lower compartment
12 aisle
20 string set
21 light bulb
22 light socket
23 conductor wires
30 package fastening means
31 spur and recess
311 spur
312 recess or hole
32 C Clamps
33 peg and strap
331 peg
332 strap
34 protrusion and strap
341 protrusion
342 strap with multi-perforation Now referring to FIG. 1, a string of decorative lighting is packed in a conventional polystyrene tray of rectangular shape. A plug and a socket leading each end of the string can be seen at the lower side corner of the tray. The whole string of light is divided into two rows which are stored in opposite trenches with an aisle between. The aisle takes the whole bunch of conductor wire sections which appear crowded within the width W of the aisle and entanglement seems unavoidable in such a condition.

Figure 2A:
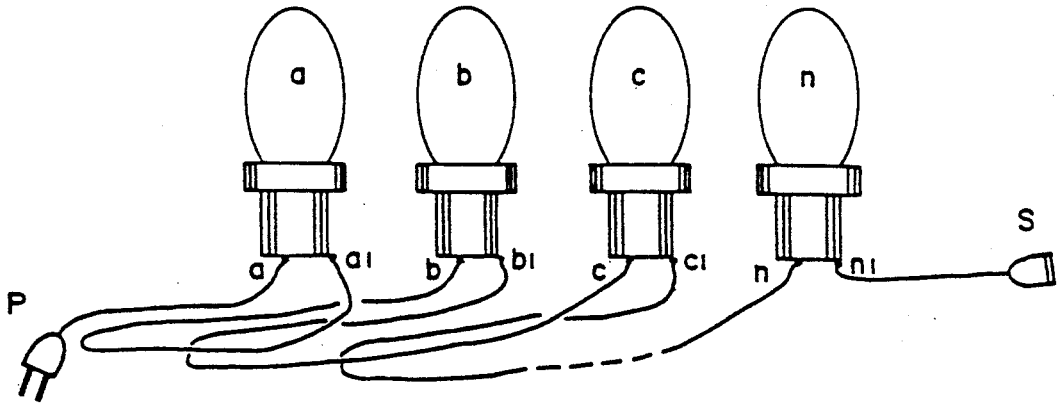
FIG. 2(A) is a diagram showing the lengths of conductor wires.

In FIG. 2(A) the string of lighting is analyzed to have been composed of a plurality of bulbs a, b, c, . . . n interconnected with conductor wire sections a1b, b1c, c1n in addition to a leading section pa including an electrical plug P as well as a tail section n1S including an extension socket S.

Let Lo be the overall length of the conductor wire, then:

$$Lo = Lpa + (La1b + Lb1c + Lc1n) + Ln1s$$

Since Lpa and Ln1s can be considered constant, then Lpa+Ln1s=Lk assume La1b=Lb1c=Lc1n thus $$Lo = Lk + n(La1b) \quad 1)$$

Figure 2B:
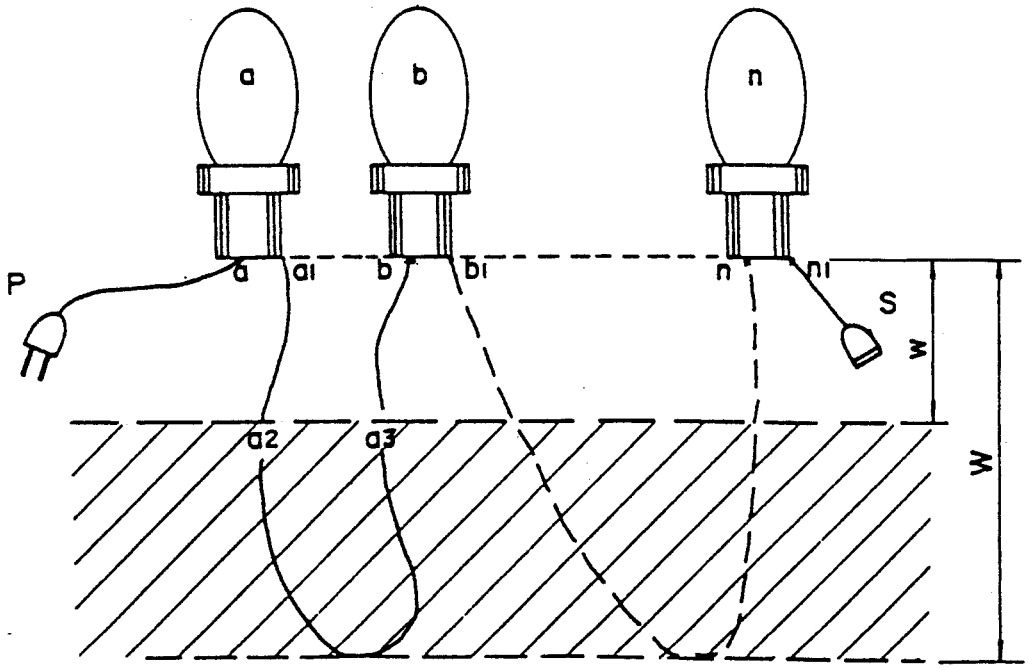
FIG. 2(B) is a diagram showing breakdown of the intermediate length of the conductor wire.

Referring to FIG. 2(B) for further breakdown of each wire sections, where $$\begin{aligned} La1b &= La1a2 + la2a3 + La3b \quad (2) \\ &= (La1a2 + La3b) + (La2a3) \end{aligned}$$

substituting (2) into (1), $$Lo = Lk + n(La1a2 + La3b) + n(La2a3) \quad (3)$$

In order to hold the overall length Lo of the conductor wire of the string, three spaces will have to be provided, one for the Lk, to take care the constant sections Lpa and Ln2s; another for the n(La1a2+La3b); still another for the intermediate sections n(La2a3).

In a conventional tray, these three spaces are all provided by the aisle between the trenches which serve to retain the bulbs.

The present inventor has found that the trench space has never been fully utilized and the space behind the bulbs is ignored. For the purpose to reduce the package volume, the intermediate sections n(La2a3) is taken out from the aisle space and moved to hide behind the bulbs stored in either trench, thus the original aisle width W can be reduced to w, and the width of the package is reduced. This in turn solves the storage and shipping problem due to the bulkiness of the package and cuts down the cost of packing material and storage and shipping space to a considerable extent.

Figure 3B:
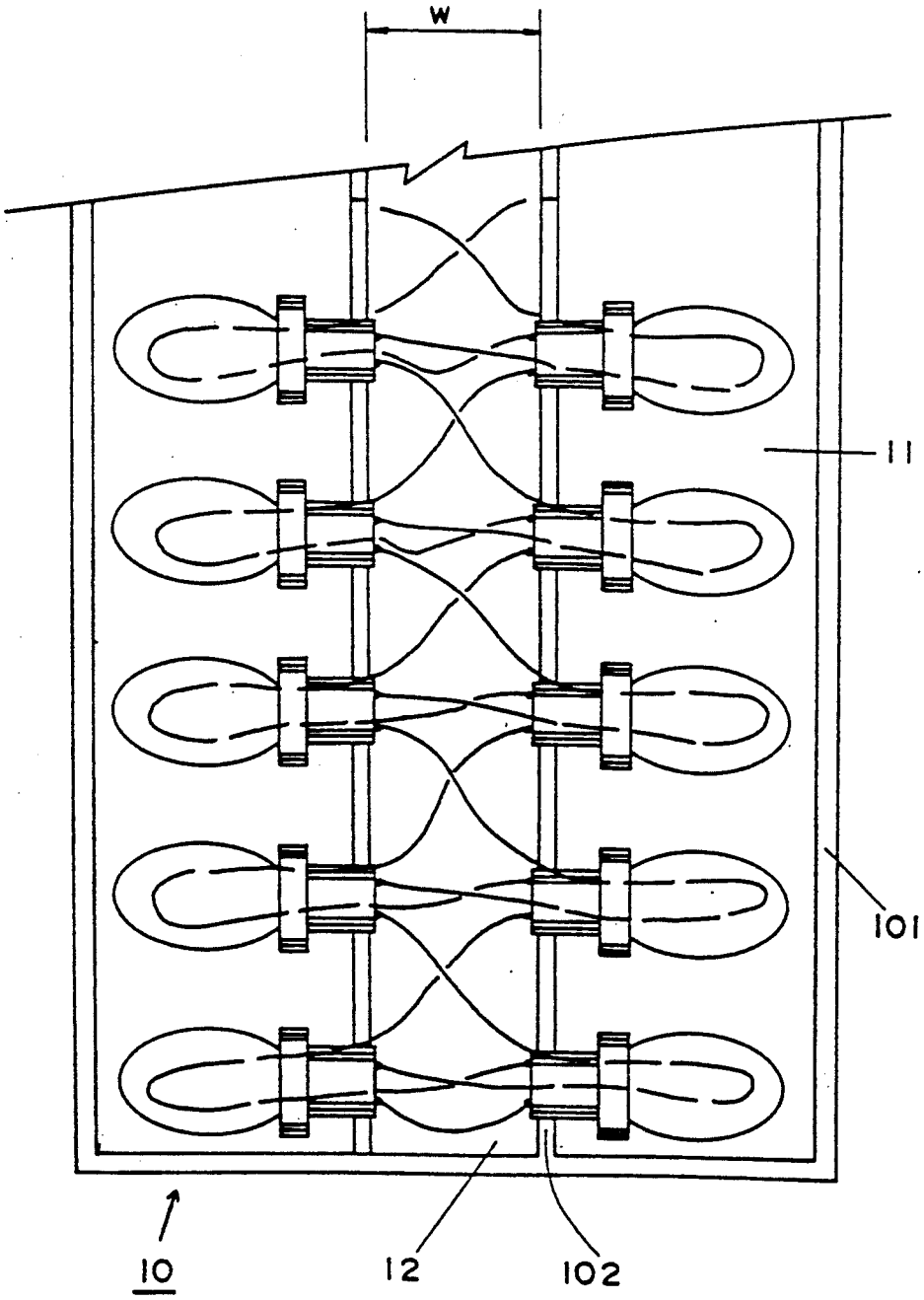

A comparison of FIG. 1 (before improvement) and FIG. 3 (after improvement) would reveal the advantageous feature of the present invention, original width of aisle W in FIG. 1 is apparently reduced to w in FIGS. 3(A) and 3(B).

FIGS. 3(A) and 3(B) also show variations of hide-away of the intermediate length of conductor wire, either behind the row of the string itself or behind the opposite row.

Figure 3C:
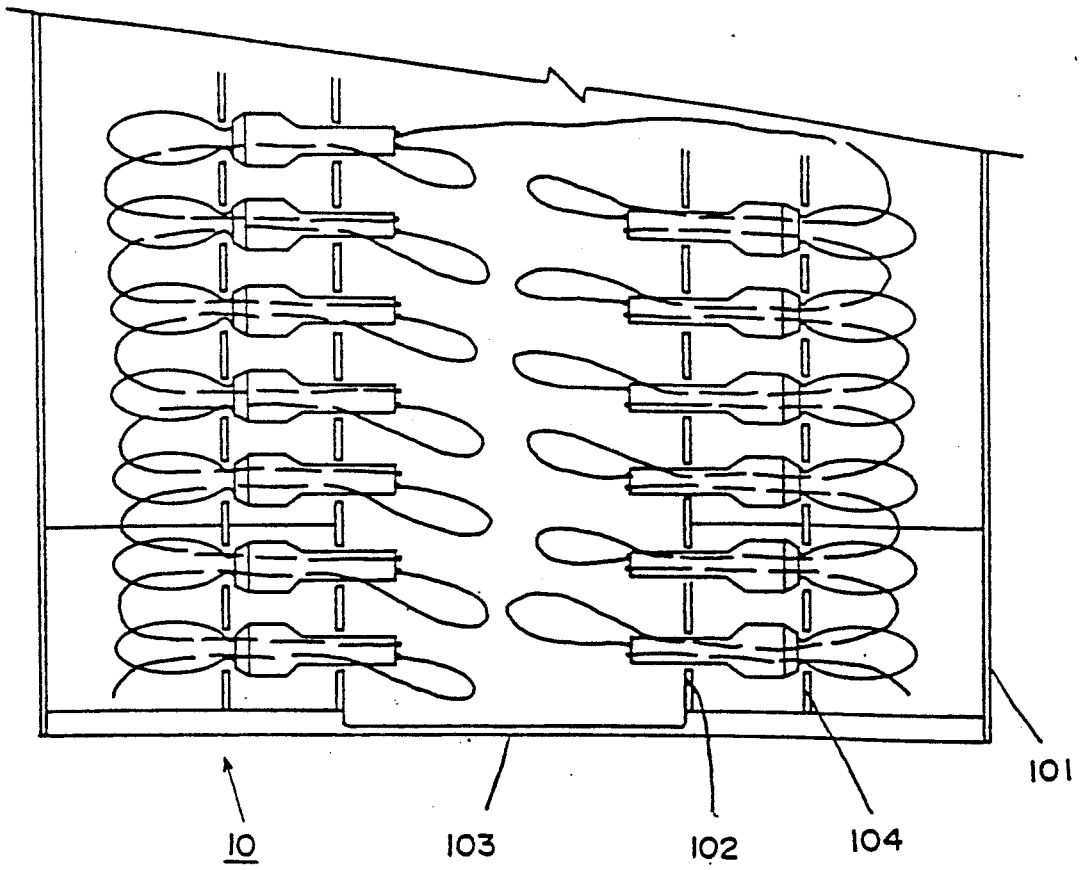
Figure 3D:
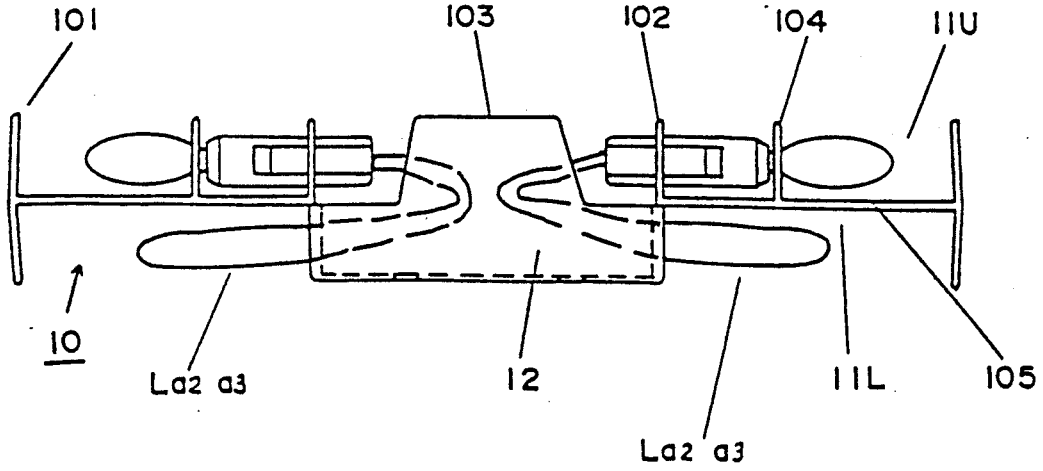

In the cross sections shown in FIGS. 3(C) and 3(D), rack means are provided to facilitate the tucking under the unutilized space of the intermediate lengths of the conductor wire. The rack means comprises a partition floor 105 spanning the side wall 101 and intermediate wall 102 of the trench 11 and bisect the trench space into an upper compartment 11U where bracket 104 is provided to retain the bulb, and a lower compartment 11L to accommodate the intermediate lengths La2a3.

Figure 3E:
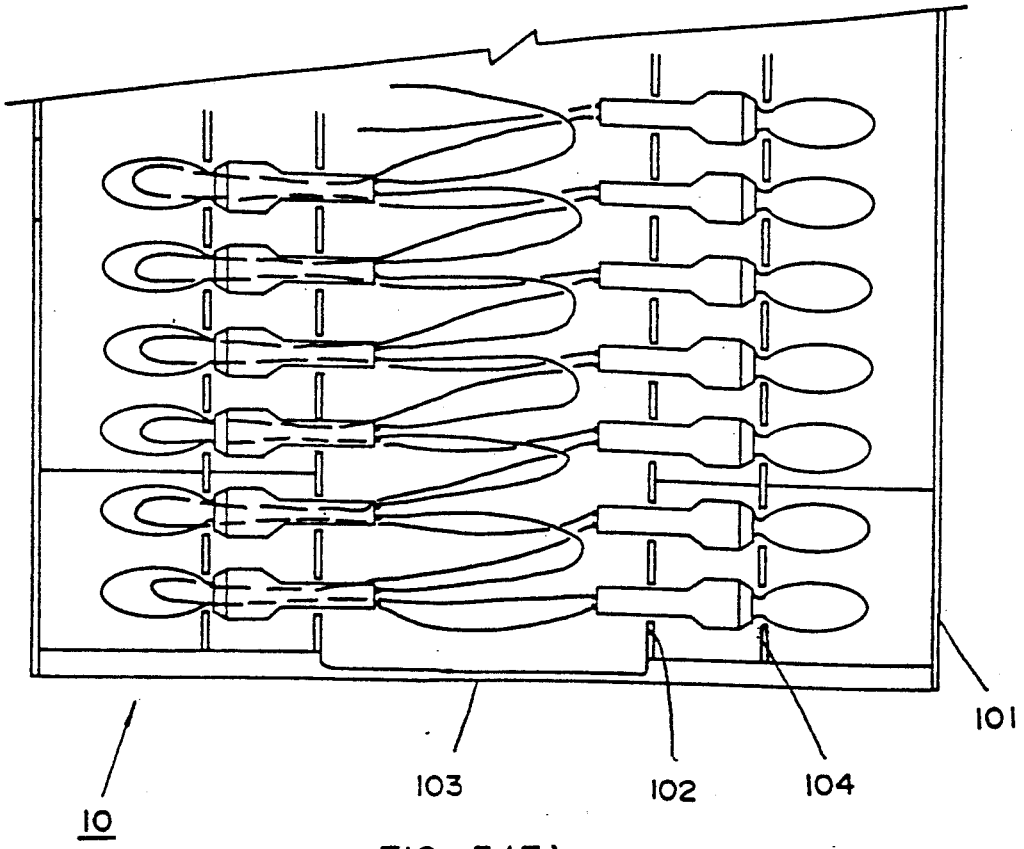
Figure 3F:
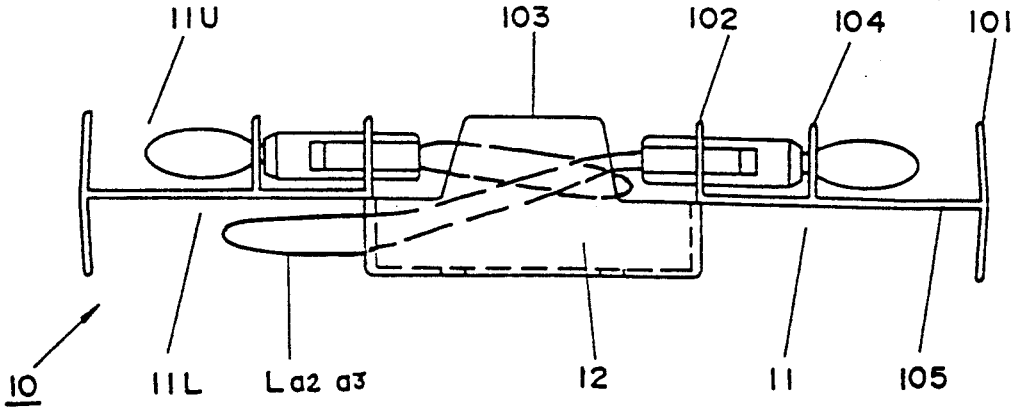
Figure 3G:
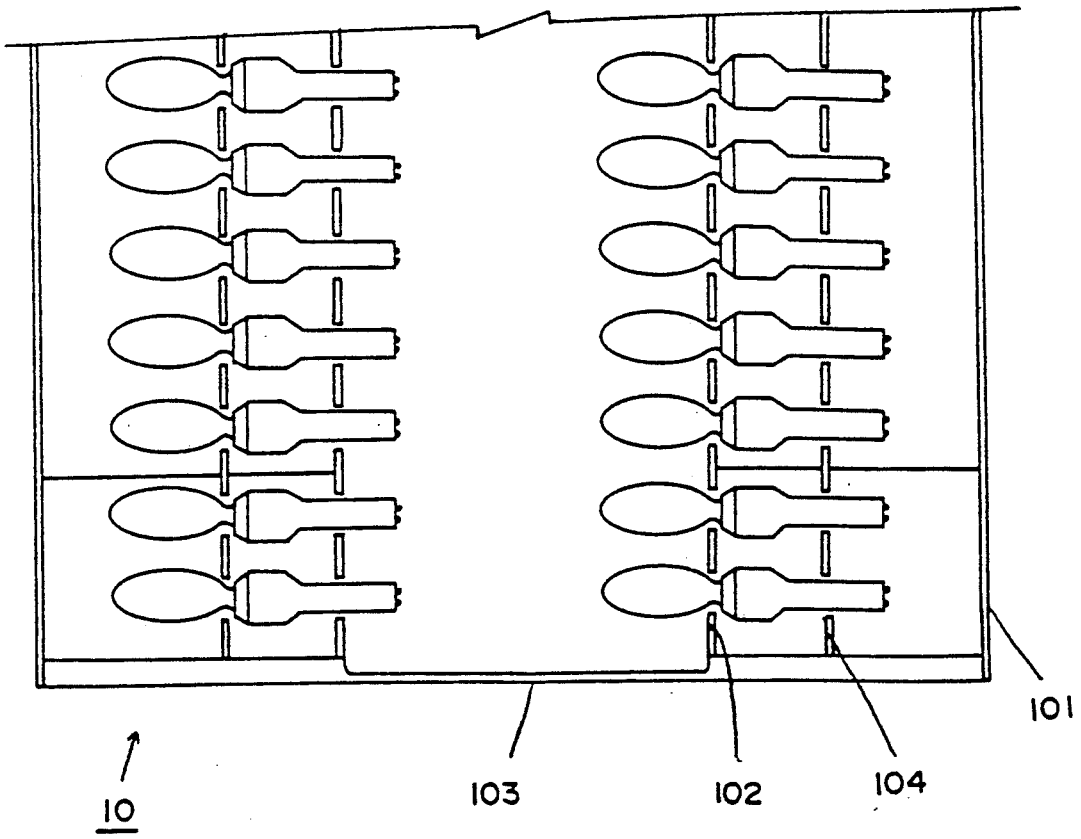

FIG. 3(E) depicts bulbs in different rows being oriented in the same direction rather than in the embodiment where bulbs in different rows across an aisle bears opposite directions. Conductor wires are omitted for simplification and clarity.

Figure 4B:
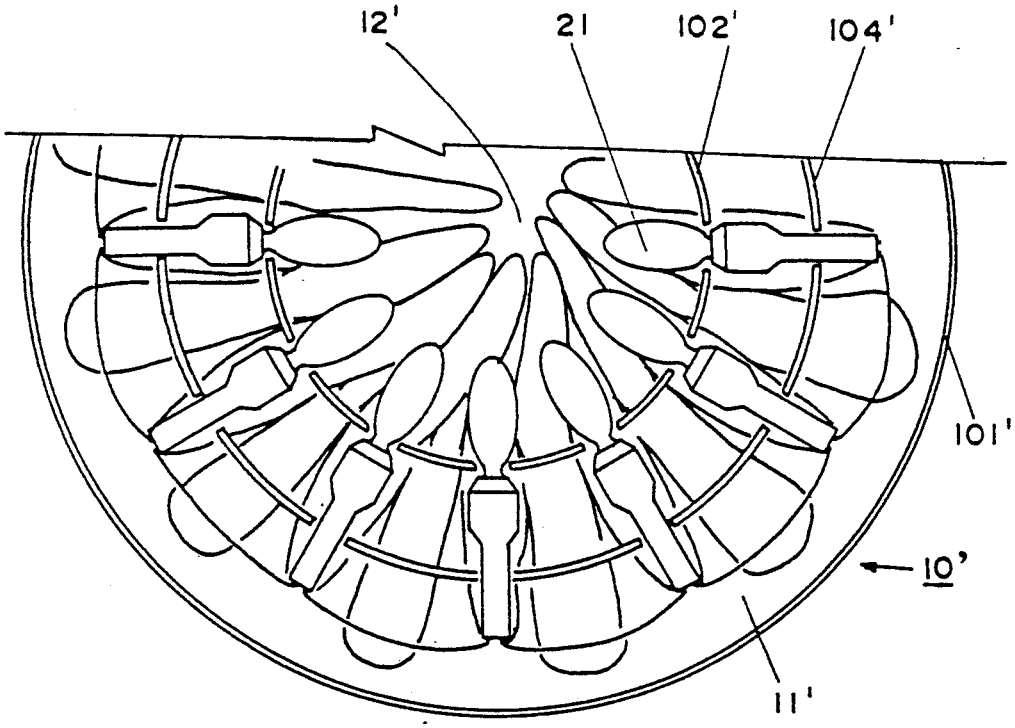

FIGS. 4(A) and 4(B) depict a second embodiment where a circular tray is related. All parts are denoted with same numerals as before, however having prime "'" marked thereon. The principle of space reduction is just the same as in the first embodiment.

Bulbs 21 in FIG. 4(A) are directed radially toward the sidewall 101' while in FIG. 4(B) are toward the center of the circle.

Figure 5B:
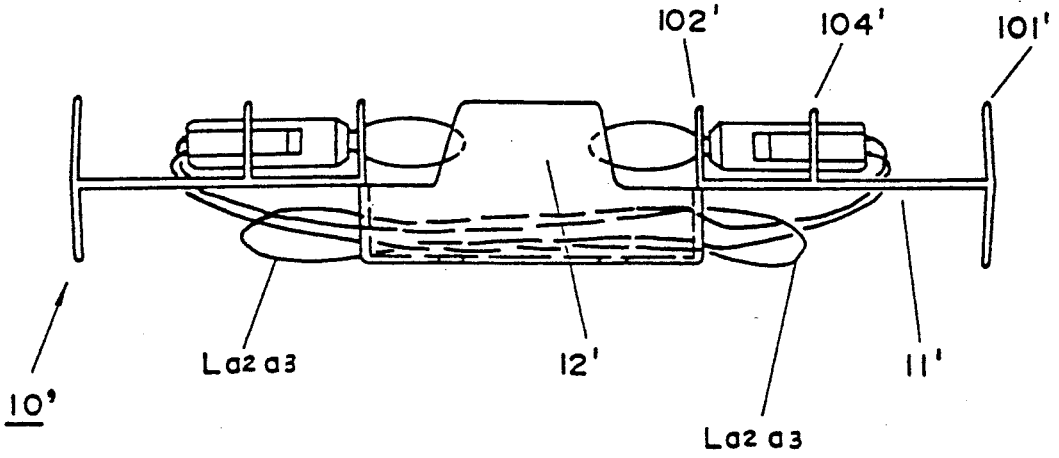

FIGS. 5(A) and 5(B) are cross-sections taken diametrically of the circular tray. The rack means and the compartments in the trench are the same as shown in FIGS. 3(C) and 3(D) for the rectangular tray.

Individual trays may need to be consolidated by stacking up or extending sidewise of trays to fulfill the requirement of a shipment of a relatively large number of bulbs. For instance, individual trays each containing a string of 20 bulbs may be stacked up to form a five tray package of 100 bulbs, such as shown in FIG. 6(A), while FIG. 6(B) shows an example where four trays are extended into a plane-package.

Under either of the abovesaid conditions, connecting or fastening means shall have to be provided to facilitate the assemblage.

FIGS. 7(A) through 7(E) show some examples usable for this purpose, of which:

7(A) is a spur and recess type of fastener where spurs 311 and recesses 312 may be provided on each tray, and the recess 312 may be in the form of a hole provided on the wall such as shown or through the floor (not shown).

Figure 7A:
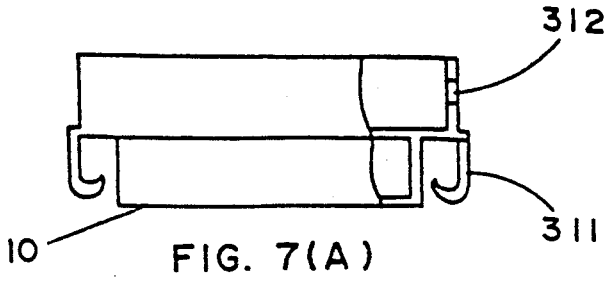
Figure 7B:
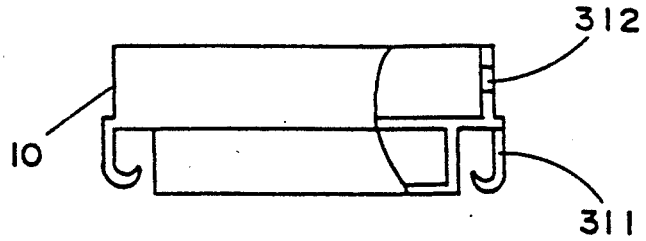

FIG. 7(B) shows a C shaped clamp 32 which can be used both for the connection of stacked trays or side extended trays.

Figure 7C:
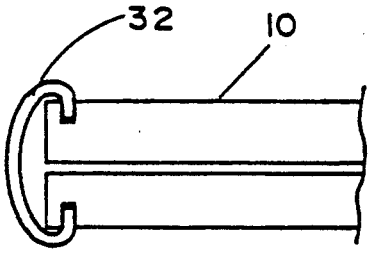
Figure 7D:
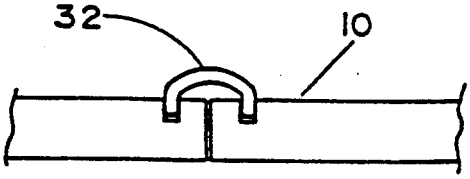
Figure 7E:
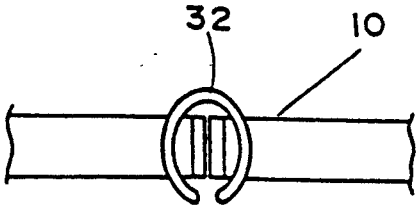
Figure 7F:
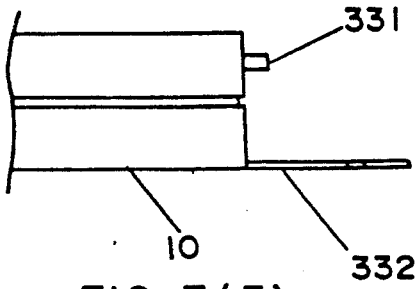
Figure 7G:
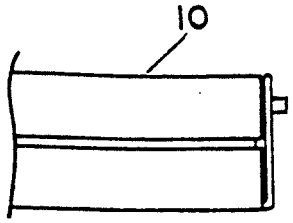
Figure 7H:
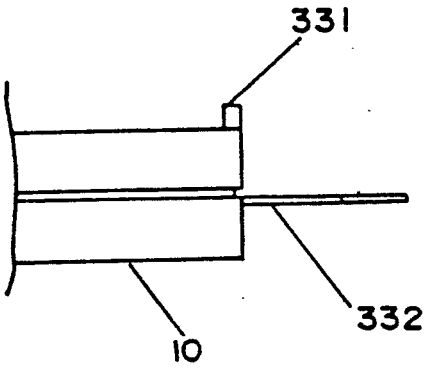
Figure 7I:
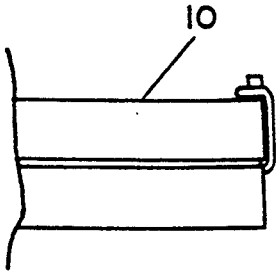
Figure 7J:
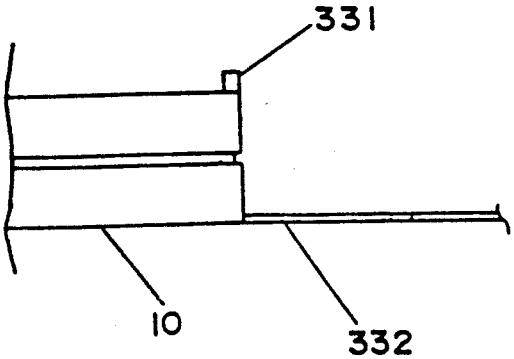
Figure 7K:
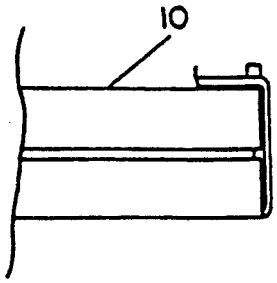

FIGS. 7(C) and 7(E) show fastening means of peg and strap type where the strap 332 having holes on it is prefixed with one end to a tray and the peg 331 may be horizontally or vertically projected from another tray to serve as anchoring or fastening means.

Since the strap 332 is made of flexible material, it can be bent to fit the peg. FIGS. 7(C) to 7(D) denote three examples of application for illustration but not limitation.

FIGS. 8(A) and 8(B) depict a further sort of fastening means, namely protrusion and strap of multi-perforation. Where the strap 342 is free for use and the protrusions 341 match the shape of hole or slot perforation can be provided on any part of the tray to be consolidated.

The abovesaid groups of fastening means are actually universally applicable to any conjunctions of two physical bodies and are not necessarily limited to the application for the consolidation of packages herein described.

We claim:

1. A method of packaging a string of a plurality of light bulbs in a circular container, each of said bulbs having a socket and wire conductors for electrical connection, said wire conductors having an intermediate portion, which consists of the steps of a) placing said bulbs in said circular container, said container having a vertical side wall and a horizontal partition, said container having a central aisle and two concentric trenches on the sides thereof, said partition dividing each of said trenches into an upper compartment and a lower compartment, b) forming a loop from said intermediate portion of each of said wire conductors;

c) placing said bulbs in circumferentially spaced positions in one of said trenches in said upper compartment and extending radially and d) placing said loops in circumferentially spaced positions in said lower compartment behind said bulbs and extending radially under said bulbs.

2. The method according to claim 1 wherein in steps c) and d) said bulbs are disposed radially towards said side wall of said circular container.

3. The method according to claim 1 wherein in steps c) and d) said bulbs are disposed radially towards the center of said circular container.

4. A method of packaging a string of a plurality of light bulbs, in a container, each of said bulbs having a socket and wire conductors for electrical connection, said wire conductors having an intermediate portion, which consists of the steps of a) dividing said string into two rows in a container, said container having a central aisle and two parallel trenches on the sides thereof;

b) placing said bulbs in said trenches;

c) forming loops from said intermediate portions of said wire conductors; and d) in each row placing said loops behind said bulbs in said container are placed under the trench in the same row where said bulbs are placed, behind said bulbs directly connected to said loops.

5. A method of packaging a string of a plurality of light bulbs, in a container each of said bulbs having a socket and wire conductors for electrical connection, said wire conductors having an intermediate portion, which consists of the steps of a) dividing said string into two rows in a container, said container having a central aisle and two parallel trenches on the sides thereof;
b) placing said bulbs in said trenches;
c) forming loops from said intermediate portions of said wire conductors; and
d) in each row placing said loops behind said bulbs in said container under the trench in the row opposite to the row where said bulbs are located, behind said bulbs opposite to said loops in the other row.

6. The method according to claim 4 wherein said container is rectangular, has side walls, a horizontal partition extends from said side walls to said aisle, said trenches being divided by said partition into an upper compartment and a lower compartment, said bulbs are placed into said upper compartment and said loops are placed into said lower compartment.

7. The method according to claim 5 wherein said container is rectangular, has side walls, a horizontal partition extends from said side walls to said aisle, said trenches being divided by said partition into an upper compartment and a lower compartment, said bulbs are placed into said upper compartment and said loops are placed into said lower compartment.

8. The method according to claim 4 wherein said bulbs are placed in said trenches in parallel rows, the bulbs in one row are arranged in one direction, and the bulbs in the other row are arranged in the opposite direction.

9. The method according to claim 5 wherein said bulbs are placed in said trenches in parallel rows, the bulbs in one row are arranged in one direction, and the bulbs in the other row are arranged in the opposite direction.

10. The method according to claim 4 wherein said bulbs are placed in said trenches in parallel rows and the bulbs in one row are arranged in the direction opposite to the bulbs in the other row.

11. The method according to claim 5 wherein said bulbs are placed in said trenches in parallel rows and the bulbs in one row are arranged in the same direction as the bulbs in the other row.

* * * * *